United States Patent [19]

Lorton, Sr.

[11] Patent Number: 4,520,997

[45] Date of Patent: Jun. 4, 1985

[54] MODEL CONSTRUCTION TOOL

[76] Inventor: Allen E. Lorton, Sr., 15906 Mount Jackson St., Fountain Valley, Calif. 92708

[21] Appl. No.: 546,750

[22] Filed: Oct. 31, 1983

[51] Int. Cl.[3] ..... B25C 11/00

[52] U.S. Cl. ..... 254/26 R; 81/20; 81/24; 81/44

[58] Field of Search ..... 254/26 R; 145/29 R, 145/30 A, 46

[56] References Cited

U.S. PATENT DOCUMENTS

| | | | |
|---|---|---|---|
| D. 31,825 | 11/1899 | Johnston | 145/46 |
| 210,041 | 11/1878 | Knauer | 254/26 R |
| 917,840 | 4/1909 | Bird | 145/29 R |
| 4,273,172 | 6/1981 | Hoosier | 145/30 R |

FOREIGN PATENT DOCUMENTS

| | | | |
|---|---|---|---|
| 508334 | 1/1955 | Italy | 145/29 R |
| 697314 | 11/1979 | U.S.S.R. | 145/29 R |

*Primary Examiner*—Frederick R. Schmidt
*Assistant Examiner*—J. T. Zatarga
*Attorney, Agent, or Firm*—Gordon L. Peterson

[57] ABSTRACT

A model construction tool for use with pins of the type used in model construction comprising a rigid body having opposite ends and a hammer surface at one of the ends adapted for pounding the pins into a surface. The body has a generally annular flange at the other of its ends with at least one slot in the flange for removing pins. The body is constructed of non-magnetic material and a magnet is carried by the body for picking up pins.

8 Claims, 4 Drawing Figures

MODEL CONSTRUCTION TOOL

BACKGROUND OF THE INVENTION

In the making of various models, such as model airplanes, the components being assembled are often attached to a board or table. This is typically done using conventional straight pins having an elongated shank and a relatively small head. Although the pins can sometimes be manually pushed through the components into the underlying board, it is also common to use a tack hammer to pound them in.

When it is desired to remove the model from the board, the pins must be pulled from the model and the board. It is often difficult to accomplish this manually, and so this task may be carried out with a pair of pliers. During work on the model, pins sometimes fall into relatively inaccessible areas adjacent one or more components of the model, and they can be difficult to retrieve.

SUMMARY OF THE INVENTION

This invention provides a model construction tool which eliminates the need for having both a hammer and a pair of pliers for use in installing and removing the pins. In addition, the tool is capable of picking up pins that fall into relatively inaccessible places during construction of the model.

These advantageous results can be accomplished by utilizing a model construction tool which comprises a rigid body having opposite ends and a hammer surface adjacent one of the ends adapted for pounding the pins into a surface. The body has a flange adjacent the other of its ends, and the flange contains at least one slot for removing the pins. To enable the tool to pick up pins even though the pins may fall into relatively inaccessible regions, a magnet is carried by the body. The magnet has exposed portions at the outer surface of the body to enable it to pick up pins. To prevent the magnet from interfering with use of the tool as a hammer or a pin puller, the body is preferably constructed of non-magnetic material.

In a preferred construction, the body terminates at its opposite ends in the hammer surface and the flange, respectively. The flange preferably extends generally axially, and one or more of the pin-pulling slots in the flange open at one end of the body. Preferably, the flange is generally annular and at least partially defines a cavity which opens at an end of the body. The flange is segmented by the slot. To facilitate construction, the cavity preferably extends into the body axially beyond the slot.

The tool can be elevated above the model components so as to clear the components when it is being used as a pin puller. To enable or assist this result, the body has an outer surface which tapers radially inwardly adjacent the end of the body where the flange is located as the outer surface extends toward such end of the body. Specifically, the flange also has an outer surface, and this outer surface also contains the above-mentioned taper. The flange also has an inner surface, and this inner surface also tapers radially inwardly as it extends axially outwardly. This permits the radial thickness of the flange to remain more even and facilitates getting the flange beneath the head of the pin which may be driven into a location closely adjacent the associated model component.

To reduce the likelihood of finger injury and for an improved line of sight, the outer surface of the body preferably tapers radially inwardly as it extends axially toward the hammer surface. In a preferred construction, the magnet is located in a bore adjacent the hammer surface, and the opposite ends of the magnet are exposed at the outer surface of the body. To prevent the tool from rolling when it is placed on a flat supporting surface, the outer surface of the body can be provided with a plurality of adjacent flat surfaces.

The invention, together with additional features and advantages thereof, may best be understood by reference to the following description taken in connection with the accompanying illustrative drawing.

DESCRIPTION OF THE PREFERRED EMBODIMENT

Figure 1:
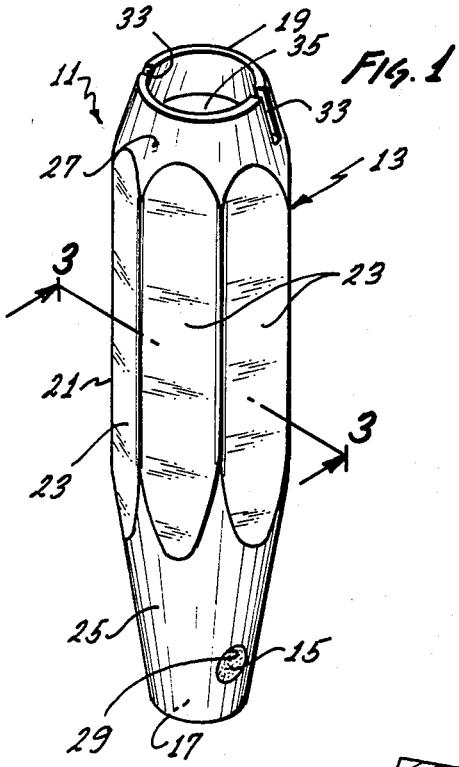
FIG. 1 is an isometric view of one form of model construction tool constructed in accordance with the teachings of this invention.
Figure 2:
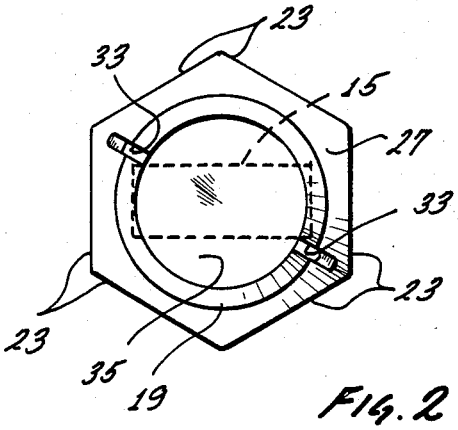
FIG. 2 is an enlarged top plan view of the tool.

FIG. 1 shows a tool 11 which generally comprises an elongated body 13 of a rigid, non-magnetic material, such as brass, and a magnet 15 carried by the body. The body has a flat, circular hammer surface 17 located at one end in a plane perpendicular to the longitudinal axis of the tool 11 and a generally annular, axially extending flange 19 at the other end. The body 13 has an exterior surface 21 which includes a plurality of flat surfaces 23 located intermediate the end of the body, a generally frusto-conical surface 25 which tapers radially inwardly as it extends axially toward the hammer surface 17 and an axially shorter, generally frusto-conical surface 27 which tapers radially inwardly as it extends axially toward the other end of the body. The frusto-conical surfaces 25 and 27 are coaxial.

The body 13 has a radially extending bore 29 (FIG. 3) which extends completely through the body at the frusto-conical surface 25 closely adjacent the hammer surface 17. The magnet 15 is retained within the bore 29 by an interference fit or other suitable means and has its opposite ends 31 exposed at the frusto-conical surface 25.

Two diametrically opposed slots 33 are provided in the flange 19. These slots 33 open at the free end of the flange 19 and they segment the flange. One or more of the slots 33 can be provided.

The body has a cavity 35 opening at one end of the body, and this cavity is partially defined by the flange 19. The cavity 35 extends axially inwardly beyond the inner ends of the slots 33.

The flange 19 has an inner frusto-conical surface 37 (FIG. 3) and an outer frusto-conical surface 39, and both of these surfaces taper radially inwardly as they extend axially toward the adjacent end of the body 13. The outer surface 39 forms all, or a major portion, of the frusto-conical surface 27.

In making the body 13 of the desired configuration, a bore 41 which forms a major portion of the cavity 35 is first drilled. Thereafter, the inner conical surface 37 and other surfaces of the cavity 35 are machined. The cone angle on the surface 37 is slightly less than the cone angle on the surface 39 to prevent completely cutting through the flange during the machining operation. By way of example, the cone angle for the surface 39 may be about 20 degrees. Also by way of example, the cone angle for the surface 25 may be about 14 degrees.

Figure 3:
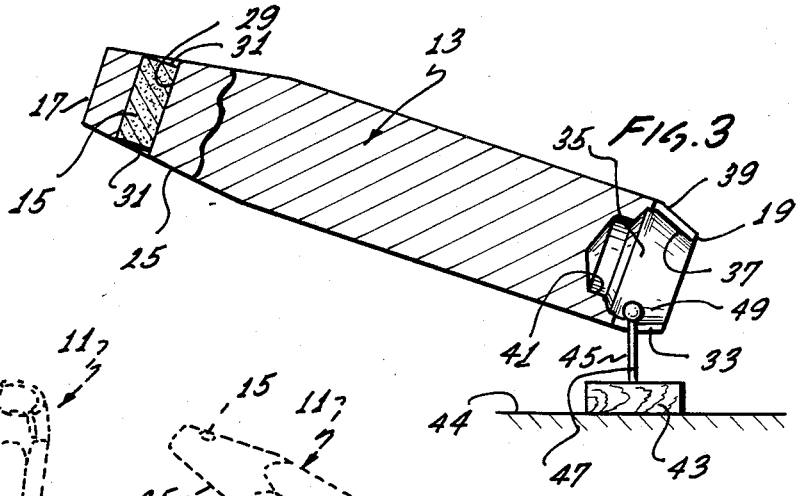
FIG. 3 is a sectional view taken generally along line 3—3 of FIG. 1 and showing the tool being used to remove a pin.
Figure 4:
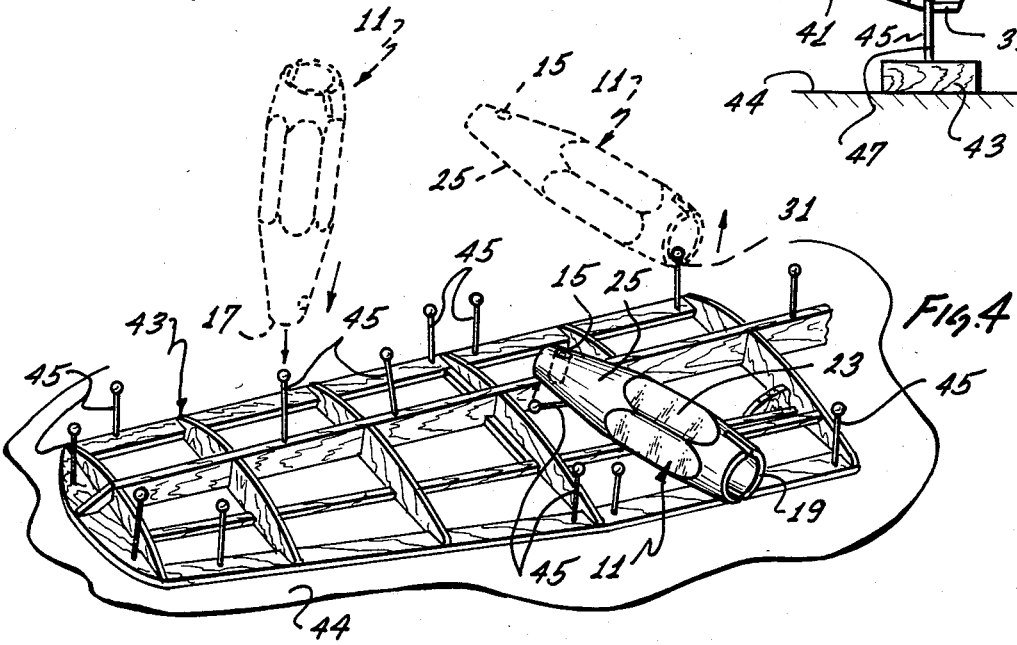
FIG. 4 is an isometric view illustrating use of the tool as a hammer, a pin remover and to pick up inaccessible pins.

FIG. 4 shows typical usages of the tool 11 and its versatility. In FIG. 4, a model in the form of a wing 43 of a model airplane is retained in position on an underlying support surface or board 44 by pins 45 which extend through various components of the wing 43 and into the support surface 44. Each of the pins 45 may be a conventional straight pin and may comprise a shank 47 terminating in one end in a sharp point and having a head 49 (FIG. 3) at the other end.

The tool 11 can be used as shown to the left in FIG. 4 as a hammer to pound the pins 45 through the various components of the wing 43 and into the supporting surface 44 using the hammer surface 17 as a hammer. The tool 11 may also be used as a pin puller as shown at the upper right in FIG. 4 and as shown in FIG. 3. To accomplish this, the shank 47 of the pin 45 to be pulled is received into one of the slots 33 through the open end thereof, and the inner surface 37 is placed beneath the head 49 as shown. Because the slot 33 is too small to allow the head 49 to pass through it, the tool 11 can then be manually pulled upwardly to remove the pin 45. Because of the cone angle or taper on the outer surface 39, the tool 11 can be placed into pin-pulling engagement with the pin 45 at an angle relative to the support surface 44 as shown in FIG. 3 to allow it to amply clear any adjacent structure.

In addition, the tool 11 can be used to pick up pins 45 which have fallen on the supporting surface 47 even if they are in relatively inaccessible places, such as in corners formed by the wing 43 and the support surface 47. A handle may be joined to the body 13 if desired.

Although an exemplary embodiment of the invention has been shown and described, many changes, modifications and substitutions may be made by one having ordinary skill in the art without necessarily departing from the spirit and scope of this invention.

I claim:

1. A model construction tool for use with pins of the type having a shank and a head and used in model construction, said model construction tool comprising a rigid body having opposite ends, said body terminating in a hammer surface at one of said ends which is adapted for pounding the pins into a surface, said body terminating at the other of said ends thereof in a generally annular, generally axially extending flange, said flange having at least one slot therein opening at said other end of the body, said slot being sized to receive the shank of the pin but being too small to allow the head of the pin to pass through it whereby the slot can be used to pull and remove the pin; said flange at least partially defining a cavity which opens at said other end of said body, said flange being segmented, by said slot; and wherein said flange has inner and outer surfaces and both said inner and outer surfaces taper radially inwardly as they extend axially toward said other end of said body.

2. A tool as defined in claim 1 wherein said cavity extends into said body axially beyond the slot.

3. A tool as defined in claim 1 wherein the body has an outer surface which tapers radially inwardly adjacent said one end of the body as the outer surface extends toward said one end of the body.

4. A tool as defined in claim 1 including a magnet carried by said body and having an exposed portion spaced from said hammer surface, said body being constructed of non-magnetic material.

5. A tool as defined in claim 4 wherein said magnet is recessed in a transverse bore in the body adjacent to but spaced from the hammer surface.

6. A tool as defined in claim 1 wherein said body has an outer surface with a plurality of adjacent flat surfaces for retaining the body against rolling when the body is placed on a surface.

7. A tool as defined in claim 1 wherein said body is elongated.

8. A tool as defined in claim 1 wherein said cavity extends into said body axially beyond the slot.

* * * * *